US006080242A

United States Patent [19]

Gajewski

[11] Patent Number: 6,080,242

[45] Date of Patent: Jun. 27, 2000

[54] METHOD FOR CLEANING TIER SHEETS

[75] Inventor: Raymond M. Gajewski, Joppa, Md.

[73] Assignee: Arrowhead Systems LLC, Randolph, Wis.

[21] Appl. No.: 09/237,832

[22] Filed: Jan. 27, 1999

Related U.S. Application Data

[62] Division of application No. 08/927,084, Sep. 10, 1997, Pat. No. 5,903,954.

[51] Int. Cl.[7] ..... A47L 5/00; B08B 1/02; B08B 3/04

[52] U.S. Cl. ..... 134/15; 134/26; 134/30; 134/32; 134/36; 134/64 R; 134/83; 134/122 R; 15/302; 15/309.1

[58] Field of Search ..... 134/15, 32, 36, 134/26, 30, 64 R, 83, 122 R; 15/302, 309.1

[56] References Cited

U.S. PATENT DOCUMENTS

| | | | |
|---|---|---|---|
| 4,103,389 | 8/1978 | Resnick et al. | 15/302 |
| 4,104,080 | 8/1978 | Sadwith | 134/23 |
| 4,377,434 | 3/1983 | Del Bianco et al. | 156/364 |
| 4,920,603 | 5/1990 | Keim et al. | 15/302 |
| 4,925,011 | 5/1990 | Kosikowski | 198/624 |
| 5,333,628 | 8/1994 | Ogata et al. | 134/64 R |
| 5,476,112 | 12/1995 | Matsui et al. | 134/64 R |
| 5,540,244 | 7/1996 | Brooks et al. | 134/56 R |
| 5,581,836 | 12/1996 | Kleber | 15/77 |

*Primary Examiner*—Zeinab El-Arini
*Attorney, Agent, or Firm*—Thomas M. Blasey

[57] ABSTRACT

The method can be performed by receiving at least one sheet and guiding the sheet through an apparatus for cleaning sheet providing tension to the sheet for processing; and processing both planar surfaces of the at least one tensioned sheet.

9 Claims, 2 Drawing Sheets

METHOD FOR CLEANING TIER SHEETS

This application is a divisional application of U.S. application Ser. No. 08/927,084, filed Sep. 10, 1997, and now U.S. Pat. No. 5,903,954.

FIELD OF THE INVENTION

The present invention relates generally to tier sheets, such as are used to separate layers of stacked articles, and to other types of flexible, substantially planar sheets. More particularly, the present invention relates to a method and apparatus for cleaning tier sheets.

BACKGROUND OF THE INVENTION

Tier sheets are commonly used in the food and beverage industry to separate stacked layers of articles such as bottles or other containers. While disposable tier sheets are known and have been widely used, reusable tier sheets have become increasingly popular. For use in the food and beverage industry, it is desirable to clean reusable tier sheets on a regular basis to avoid potential contamination.

Reusable tier sheets are typically constructed of a synthetic material such as rubber or plastic, and are formed as relatively thin, flexible, and substantially planar sheets. Due to the flexibility of the reusable tier sheets, the sheets have relatively limited structural integrity, and therefore can be difficult to clean. Typically, the reusable tier sheets are washed by hand, which can be a time consuming and difficult task. Further, the washed sheets must also be thoroughly dried. If sheets which are washed are not thoroughly dried, mold and mildew can form on the sheets, particularly if partially-dry sheets are stacked together.

It would therefore be desirable to be able to wash, dry, or otherwise process reusable tier sheets quickly and easily.

It would further be desirable to automatically achieve a substantial dryness of cleaned sheets.

It would further be desirable for a sheet cleaning system to automatically provide tension for cleaning the sheet.

SUMMARY OF THE INVENTION

The present invention overcomes the above-described problems, and achieves other advantages, by providing for a method and apparatus for processing flexible, substantially planar sheets, such as reusable tier sheets. According to exemplary embodiments of the invention, an apparatus for washing, drying or otherwise cleaning or processing the sheets includes a guiding means, such as adjustable upper and lower guide rails, for receiving at least one sheet and guiding the sheet through the apparatus; a plurality of rollers which rotate to move each sheet through the apparatus and provide tension to the sheet(s) for processing; and one or more processing stations on chambers for processing (e.g., washing and drying) the tensioned sheet. In effect, the apparatus according to the present invention provides each sheet with enhanced structural integrity to greatly facilitate the processing of the sheet. An exemplary method according to the present invention includes the steps of receiving a flexible, substantially planar sheet, providing tension to the sheet, and performing one or more cleaning or processing steps on the sheet (e.g., washing the sheet, drying the sheet, etc.).

The method and apparatus of the present invention allows reusable sheets to be cleaned, dried, and otherwise processed in an efficient and reliable manner.

BRIEF DESCRIPTION OF THE DRAWINGS

The present invention can be more fully understood upon reading the following Detailed Description of the Preferred Embodiments in conjunction with the accompanying drawings, in which like reference indicia designate like elements, and in which.

DETAILED DESCRIPTION OF THE PREFERRED EMBODIMENTS

Figure 1:
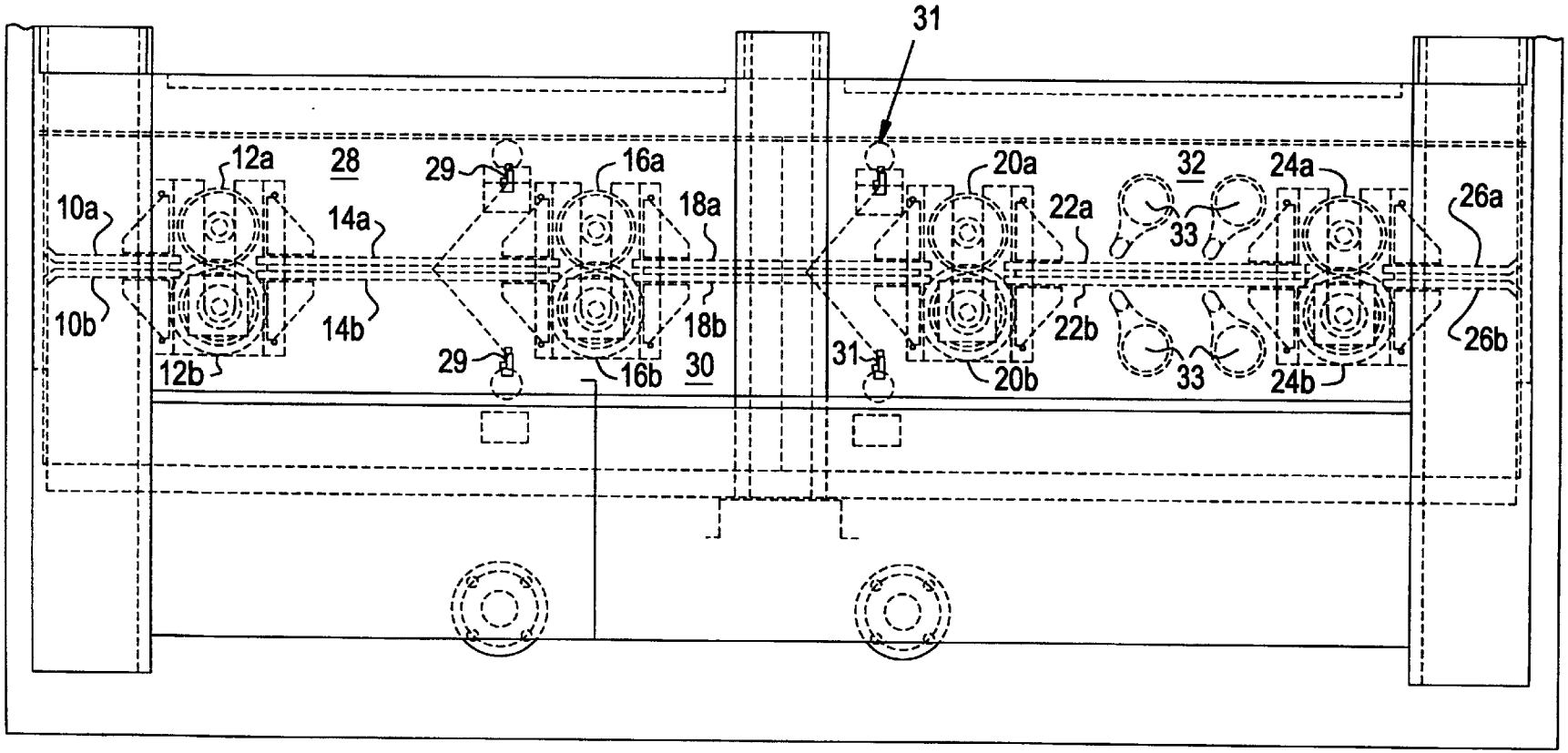
FIG. 1 is a side view of a sheet cleaning apparatus according to a first embodiment of the present invention.

FIG. 1 shows a side view of a sheet cleaning apparatus according to an embodiment of the present invention. The apparatus includes first upper and lower guide rails 10*a* and 10*b*, first rollers 12*a* and 12*b*, second upper and lower guide rails 14*a* and 14*b*, second rollers 16*a* and 16*b*, third upper and lower guide rails 18*a* and 18*b*, third rollers 20*a* and 20*b*, fourth upper and lower guide rails 22*a* and 22*b*, fourth rollers 24*a* and 24*b*, and fifth upper and lower guide rails 26*a* and 26*b*. In the embodiment of FIG. 1, three processing chambers or stations are provided: a washing station 28 between the first and second rollers; a rinsing station 30 between the second and third rollers, and a drying station 32 between the third and fourth rollers. Each pair of upper and lower guide rails functions to receive at least one sheet and to guide the sheet through the cleaning apparatus and the various processing chambers. Each pair of rollers functions to receive, guide, and drive each sheet through the apparatus, and to provide sufficient tension to each sheet for processing. It should be appreciated that the drying chamber or station may be located externally to the apparatus, and/or may be separated by a gap or other suitable protective means to prevent the liquids used at the washing or rinsing stations from interfering with the drying process. Depending upon the application, it may also be desirable to provide gaps or other suitable protective means between other processing chambers or stations, or between separate individual sheets, to prevent separate claiming processes from interfering with each other.

In operation, a sheet is provided through the guide rails 10*a* and 10*b* and driven into the washing chamber 28 by first rollers 12*a* and 12*b* until the sheet reaches and is engaged by second rollers 16*a* and 16*b*. Because, at this time, the sheet is simultaneously engaged by both first rollers 12*a*, 12*b* and second rollers 16*a*, 16*b*, tension and integrity are provided to the sheet for washing in the washing chamber 28. After washing, the second rollers 16*a* and 16*b* continue to drive the sheet forward toward a later processing chamber or station, and eventually the first rollers 12*a* and 12*b* no longer engage the sheet, and are then ready to accept a second sheet. Thus, in each chamber or processing station, each sheet is provided with tension as a result of being engaged by two sets of rollers.

The washing chamber 28 is provided with one or more wash headers 29 which provide a suitable washing fluid to the chamber. The wash headers 29 preferably include jet spray nozzles for providing the washing fluid to a sheet with sufficient force to clean the sheet. The rinsing chamber 30 is provided with one or more rinse headers 31, which preferably include jet spray nozzles, to rinse the cleaned sheet. As will be appreciated by those of ordinary skill in the art, the rinsing chamber preferably rinses the washed sheet sufficiently to remove substantially all washing fluid for drying of the sheet at the drying station 32. The drying station 32 includes one or more blow-off knives 33 other suitable drying means for providing air at a sufficient quantity and velocity to achieve substantially complete drying of the sheet. The blow-off knives are preferably sufficient in number and suitably positioned to achieve a substantial dryness of the sheet. As will be appreciated by those skill in the art, sheets which are not substantially dry may develop mold or mildew if, for example, the partially-dry sheets are placed in a stack while not being used to separate layers of stacked articles.

Alternatively, the cleaning can be performed by one or more air cleaning stations in which ionized air is provided in sufficient force and quantity to clean the sheet. In such an embodiment, a vacuum system can be provided to the drying station to vacuum the sheets of loose particles.

Figure 2:
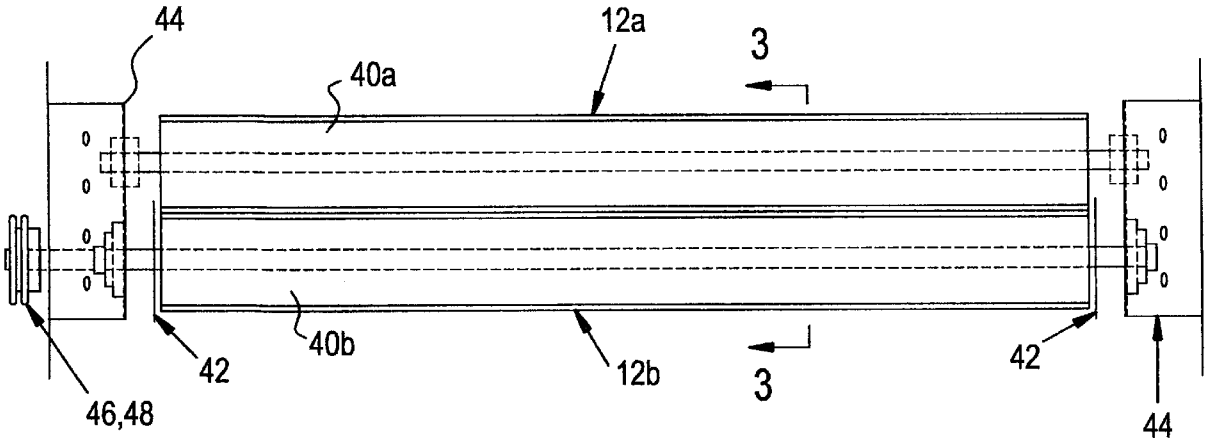
FIG. 2 is a frontal view of the roller assembly of the embodiment of FIG. 1.

FIG. 2 shows a frontal view of a roller assembly, such as may be used in the embodiment of FIG. 1. The rollers will be described as first rollers 12*a* and 12*b*, but it will be appreciated that each roller assembly is substantially identical to that shown in FIG. 2. Roller 12*a* is an upper roller and roller 12*b* is a lower roller. Upper and lower rollers 12*a* and 12*b* rotate about central shafts 40*a* and 40*b*, respectively. Lower roller 12*b* is provided with alignment or retention guides 42 which prevent the sheets from being horizontally displaced as they are guided and driven through the apparatus and its various processing stations or chambers.

According to one aspect of the present invention, central shaft 40*b* of lower roller 12*b* is rotatably mounted in at least a temporarily fixed position inside roller assembly housing 44, while central shaft 40*a* of upper roller 12*a* is rotatably mounted in roller assembly housing 44 in such a manner so as to allow the central shaft 40*a* to "float" in a vertical direction. By allowing the upper roller 12*a* to float in a vertical direction, the rollers 12*a* and 12*b* can accommodate sheets of varying thicknesses automatically and in a self-adjusting manner. Because the upper roller 12*a* is located above the lower fixed roller 12*b*, gravity provides sufficient tension to ensure that the rollers sufficiently engage each sheet. To drive each sheet through the rollers, to lower fixed roller 12*b* is driven as a pulley by the combination of a sprocket 46, attached to the lower central shaft 40*b*, and a roller chain 48. Preferably, the various roller assemblies (12, 16, 20, and 24 in the example shown in FIG. 1) each have their respective lower rollers driven in a synchronized manner by the same roller chain 48. It will be appreciated that a belt or other pulley driving mechanism can be used, that other methods for synchronizing the rollers can be used, and that the rollers need not be synchronized depending upon the application. A suitable controlled driving means (not shown) controls the rotation of the lower rollers to drive the sheets and provide tension. Rollers 12*a* and 12*b* can be stainless steel pulleys which are coated with a layer of material to enhance the engagement of the sheet material. According to one embodiment of the present invention, a 0.250" layer of natural rubber is provided on the rollers. It should also be appreciated that, as shown in FIG. 2, the rollers 12*a* and 12*b* engage the substantial entirety of the width of a sheet to ensure that the sheet is securely driven through the apparatus and is sufficiently engaged between rollers to allow for thorough washing and drying of the sheet.

Figure 3:
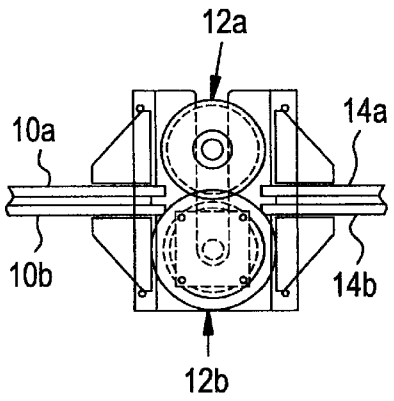
FIG. 3 is a detailed side view of the roller assembly and guiding assembly of the embodiment of FIG. 1.

FIG. 3 shows a detailed side view of the roller assembly including rollers 12*a* and 12*b*, and upper and lower guide rails 10*a*, 10*b*, 14*a*, 14*b*. Preferably, upper and lower rollers 12*a* and 12*b* are removable through the top of the apparatus for replacement or servicing. Also, it is preferable that the upper and lower guide rails are adjustable to accommodate sheets of varying thicknesses. The guide rails can be adjusted to allow the sheets to be passed through and between the processing chambers of the apparatus without significantly impeding the sheets, but to prevent the sheets from flexing during the processing (washing, rinsing, drying, etc.).

In operation, the apparatus of FIGS. 1–3 performs a method according to the present invention, as will now be described. The method includes the steps of receiving at least one sheet in a processing chamber, providing tension to the at least one sheet sufficient to allow effective cleaning or processing of the sheet, and processing the sheet such as by washing, rinsing, or drying the sheet.

While the foregoing description has included many details and specificities, it is to be understood that these are for purposes of explanation only, and are not to be construed as limitations of the present invention. Numerous modifications to the disclosed embodiments will be readily apparent to those of ordinary skill in the art without departing from the spirit and scope of the invention, as defined by the following claims and their legal equivalents.

What is claimed is:

1. A method for cleaning one or more flexible, substantially planar sheets, each sheet having two planar surfaces, comprising the steps of:

receiving at least one sheet at a cleaning station with either of a first or second planar surface of the sheet facing, a first direction;

providing tension to the at least one sheet while at the cleaning station; and cleaning both planar surfaces of the at least one tensioned sheet independently of whether the first or second planar surface faces the first direction.

2. The method of claim 1, wherein the step of cleaning includes washing or drying the at least one tensioned sheet.

3. The method of claim 1, further comprising the step of moving the at least one sheet into and between multiple cleaning stations.

4. The method of claim 3, wherein the step of moving is performed by a plurality of rollers.

5. The method of claim 4 wherein the step of providing tension is by performed by the plurality of rollers.

6. The method of claim 4, further comprising the step of automatically adjusting the rollers to accommodate sheets of differing thicknesses.

7. The method of claim 1, wherein the step of cleaning the at least one tensioned sheet achieves a substantial dryness.

8. The method of claim 1, wherein the step of cleaning is performed by cleaning elements arranged on opposite planar surfaces of the at least one sheet.

9. The method of claim 8, wherein the cleaning elements are substantially identical.

* * * * *